United States Patent [19]

Nalbach

[11] Patent Number: 4,465,111

[45] Date of Patent: Aug. 14, 1984

[54] CONTAINER FILLING APPARATUS HAVING MAGNET AND VIBRATOR CONNECTED THERETO

[75] Inventor: John C. Nalbach, La Grange Park, Ill.

[73] Assignee: John R. Nalbach Engineering Co., Inc., Chicago, Ill.

[21] Appl. No.: 460,164

[22] Filed: Jan. 24, 1983

[51] Int. Cl.[3] ..... B65B 3/04

[52] U.S. Cl. ..... 141/79; 141/165; 141/DIG. 1; 198/394; 198/690; 366/108

[58] Field of Search ..... 211/DIG. 1; 248/206 A; 53/525, 272, 276, 277, 278, 279; 141/1-12, 69-81, 129-191, DIG. 1; 198/394, 690; 366/108, 109, 273

[56] References Cited

U.S. PATENT DOCUMENTS 3,338,374 8/1967 Dudley ..... 198/690

3,967,659 7/1976 Warner et al. ..... 141/79

FOREIGN PATENT DOCUMENTS 761371 7/1978 U.S.S.R. .

*Primary Examiner*—Houston S. Bell, Jr.

*Attorney, Agent, or Firm*—Anthony S. Zummer

[57] ABSTRACT

The present invention relates to an improvement in an apparatus for filling like magnetic containers with a like measured amount of divided material product. The apparatus includes a magnet positioned adjacent to a portion of a path of magnetic containers in cooperation with product measuring devices. The magnet attracts the containers with divided material product contained therein. A vibrator is connected to the magnet for vibrating the magnet and a container attracted to the magnet to compact divided material product in the container.

16 Claims, 6 Drawing Figures

CONTAINER FILLING APPARATUS HAVING MAGNET AND VIBRATOR CONNECTED THERETO

BACKGROUND OF THE INVENTION

The present invention is an improvement of the container filling apparatus taught in U.S. Pat. No. 3,967,659, to Warner et al, issued July 6, 1976.

The container filling apparatus taught in the above identified Warner et al patent is adequate for filling containers with certain divided material product. In certain instances, it is desirable not only to fill a container, but also to compact the divided material product in the container. In order to compact a divided material product in a container and to have the container filled with the proper amount of material, it is desirable to vibrate the container at the end of the filling operation.

SUMMARY OF THE INVENTION

The present invention relates to an improved construction for an apparatus used for filling like magnetically attractive containers with a like measured amount of powder, granules or divided material product. The present apparatus includes a housing having a drive mounted in the housing. A filling tank is mounted in the housing. The filling tank has a base connected to the drive to be rotated thereby. A plurality of product measuring devices is connected to the rotatable base of the filling tank for receiving divided material product from the tank and determining a given measured amount of product. Said product measuring devices are arranged in a circle. The product measuring device circle has its center concentric with the center of the circle of rotation of the rotatable base. A measured amount of product is dispensed from each product measuring device into its respective container.

A container pocket is positioned adjacent to each of the product measuring devices. The container pocket revolves with its respective measuring device and intermittently carries a container positioned in the pocket. Each container in each pocket intermittently telescopes with the respective product measuring device. An arcuate container support is positioned in the housing below a portion of the circle of product measuring devices for intermittently holding containers in telescoping relationship with respective product measuring devices. The arcuate container support allows the containers to move downward relative to the product measuring devices through a given portion of the circle path of the product measuring devices. A magnet is positioned adjacent to a horizontally level portion of the circular path of the product measuring devices for attracting containers as they pass the magnet and for rotatably holding the containers. A vibrator is connected to the magnet for vibrating the magnet and a container attracted to the magnet to compact divided material product in the container.

DESCRIPTION OF THE PREFERRED EMBODIMENT

Figure 1:
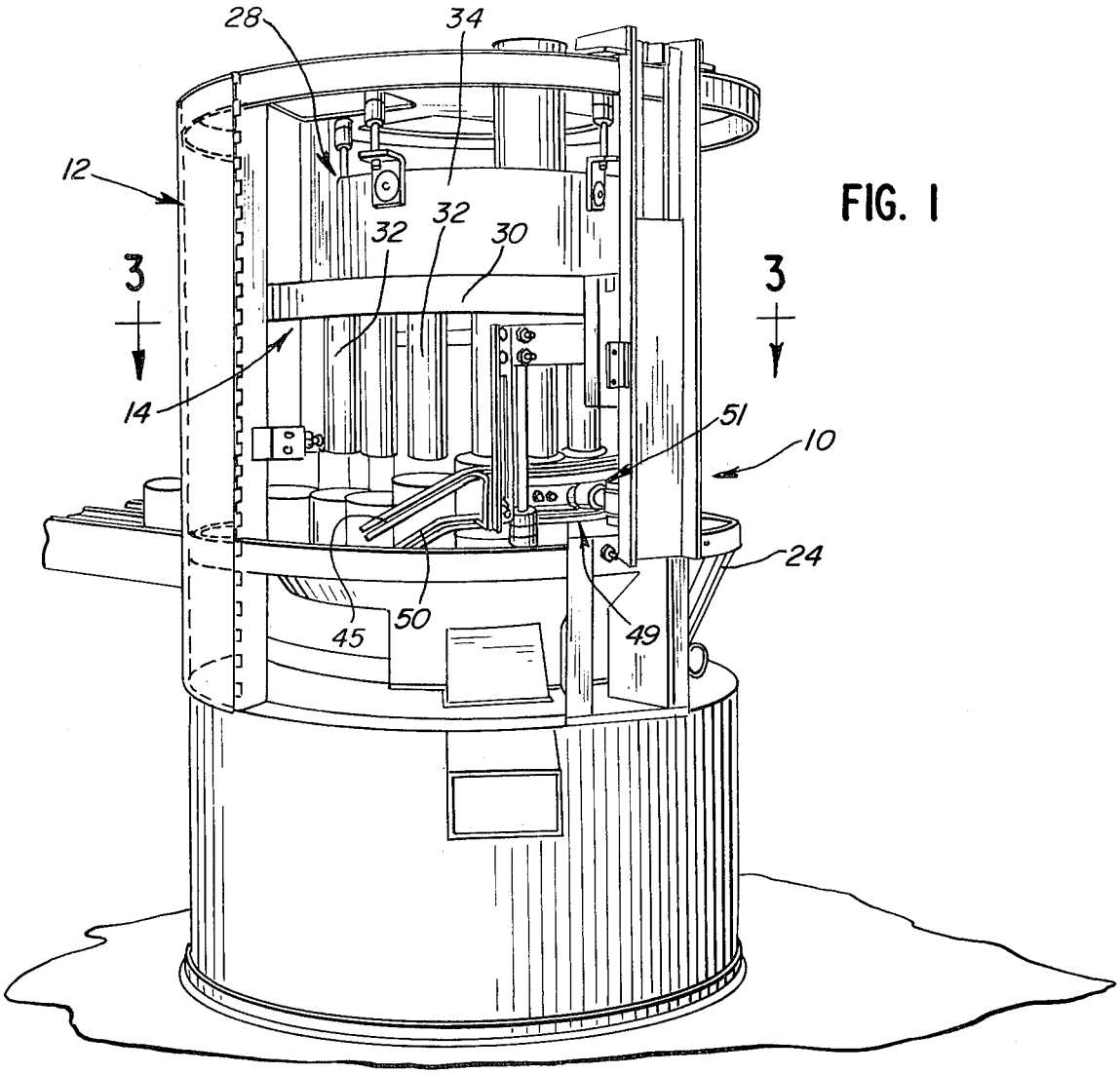
FIG. 1 is a perspective view of a container filling apparatus embodying the herein disclosed invention.
Figure 2:
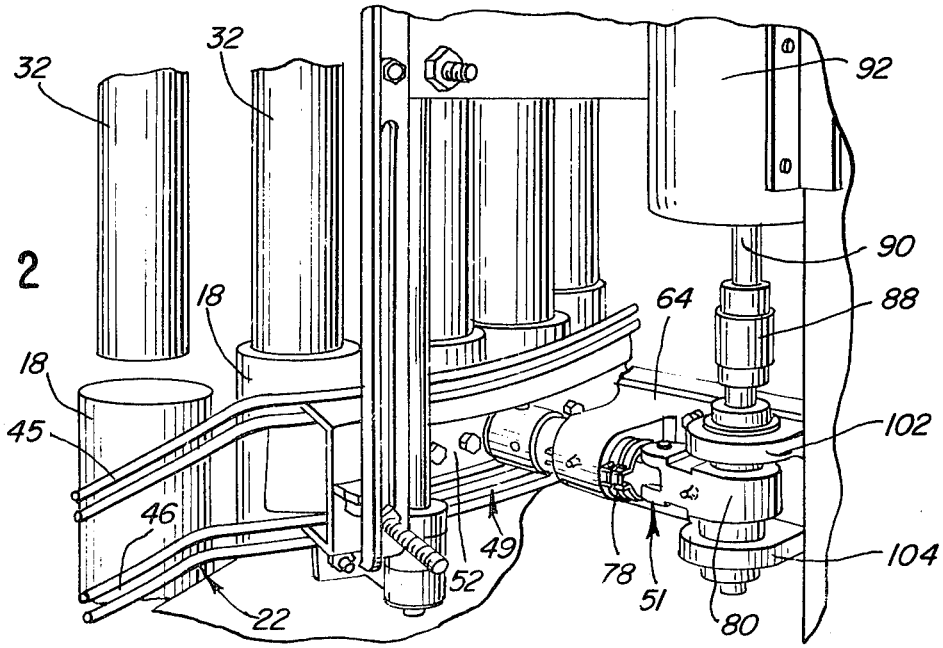
FIG. 2 is an enlarged perspective view of a portion of the apparatus of FIG. 1 showing an arcuate magnet and a vibrator connected to the magnet.

Referring now to the drawings and especially to FIG. 1, a container filling apparatus embodying the present invention, generally indicated by numeral 10, is shown therein. Apparatus 10 generally includes a conventional housing 12. A filling turret 14 is mounted in the upper portion of the housing. The filling turret is connected to a conventional variable speed drive 15. As may be seen in FIG. 3, an input conveyer 16 delivers to the filling turret a plurality of empty magnetically attractive containers 18, and an output container 20 carries away from the filling turret filled containers. A container elevator 21 raises empty containers to an arcuate container support 22. Support 22 holds the containers in a vertical direction and allows the containers to drop down at selected stations. A spillage recovery assembly 24 is positioned in the housing surrounding the filling turret to recover spilled divided material product.

Filling turret 14 is connected to a drive shaft 26 which is connected to drive 15. The filling turret includes a filling tank 28 mounted in the upper portion of the housing. The filling tank has a rotatable tank floor or base 30 which is drivingly connected to drive shaft 26 to rotate with the shaft. The tank floor has a plurality of identical product measuring devices which are in this specific instance cylindrical measuring flasks 32 depending from the tank floor so that each of the flasks extends vertically downward from the floor so that the flasks are parallel to each other. The upper portion of each flask opens into the tank through the tank floor. Flasks 32 are arranged in a circle concentric with the drive axis of rotation of the drive shaft and the longitudinal axis of each flask is parallel to the axis of rotation. The axis of rotation of the measuring flasks is concentric with the center of the floor. The tank includes a side wall 34 which forms a closed figure for holding selected, granual powered or divided material product. Side wall 34 is fixed to the housing so that the tank floor slides under side wall 34 as the tank floor rotates with the drive shaft.

Figure 3:
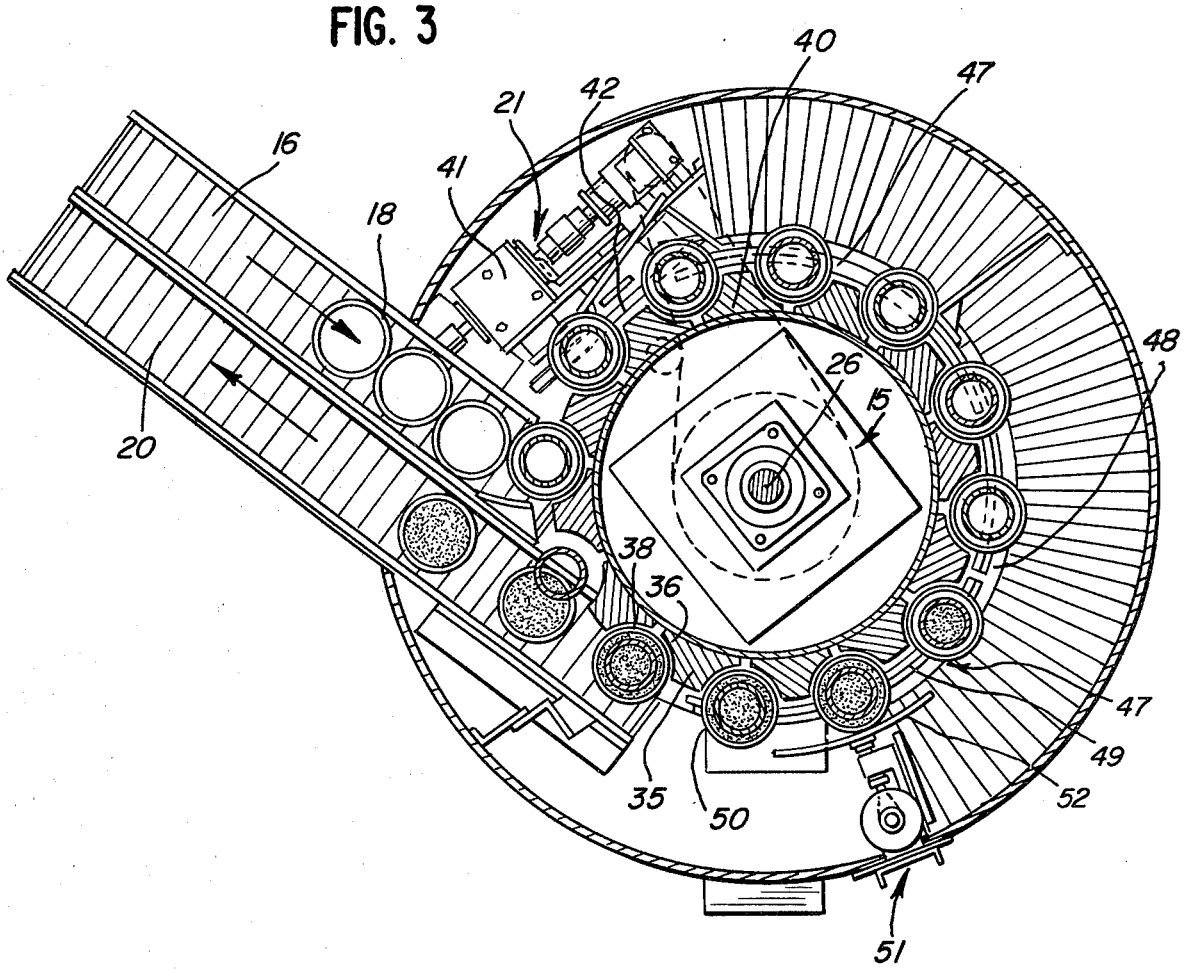
FIG. 3 is a cross sectional plan view of a portion of the apparatus of FIG. 1 showing the relationship of a loading conveyer and an unloading conveyer to a filling turret handling containers during filling of the containers and the position of the arcuate magnet and vibrator relative to containers during the filling operation.

As may be seen in FIG. 3, the filling turret includes a peripheral circular wall 35 which has a plurality of container pockets 36. Each of the container pockets is defined by a respective pocket wall 38 and is adapted to receive one of the containers. Each of the container pockets is alligned with a respective measuring flask 32. The container pockets are arranged in a circle concentric with the circle of the measuring flasks. A container delivered to a container pocket by the input conveyer is first raised into a telescoping relationship with the respective measuring flasks by the container elevator. As the container rotates with its pocket, the container supported on the container support and is lowered relative to the respective flask. The walls of the pocket are mounted on a drum 40 and rotate with the drum and tank floor. The container elevator 21 is conventional in its construction.

The elevator includes an elevator drive 41 which is connected to an elevator belt 42 which in turn is adapted to raise empty containers from the level of the input conveyer to arcuate support 22.

The arcuate support includes a support rail 44 and a pair of side rails 45 and 46. The arcuate support extends along a portion of the drum to retain the containers in the pockets and thereby hold each of the containers in a selected telescoping relationship with its respective flask. The arcuate support contains a horizontal section 47 at the delivering end of container elevator 21 where the bottom of the measuring flask telescopingly receives the container. A first drop portion 45 has its upper end adjacent to horizontal section 47 and its lower end adjacent to a horizontal section 49 where the containers are positioned with each container top substantially at the same height as the bottom of the measuring flask. A second drop portion 50 lowers the container from section 49 to the output conveyer.

A vibrator assembly 51 is positioned between the rails 45 and 46 for vibrating the containers carried in the pockets as they pass through horizontal section 49.

The vibrator assembly includes an arcuate permanent magnet 52 positioned between side rails 45 and 46. The magnet has a curved outer face 53 which is a portion of a circle concentric with the circle of rotation of the measuring flasks. The magnet is connected to an elongated rod 54. The magnet has a pair of ears 56 formed thereon. The rod has a pin aperture 58 extending therethrough. A connector pin 60 is mounted in ears 56 and in aperture 58 to connect the rod to the magnet. A sleeve 62 slidably receives rod 54. The rod is movable along its longitudinal axis in the sleeve, which longitudinal axis is perpendicular to the portion of outer face 53 opposite ears 56. The sleeve is mounted on a base 64 which is mounted in housing 12. The rod includes a head 66 with a head aperture 68 formed therethrough. An arm 70 includes a clevis 72 with a head pin 74 extending through clevis 72 and head aperture 68. Seals 76 and 78 are mounted on opposite ends of sleeve 62 to prevent foreign matter from entering the space between the rod and the sleeve. Arm 70 includes an eccentric aperture 80 with a bearing 82 mounted therein. A drive shaft 84 has an eccentric 86 fixed thereon. The eccentric is mounted in bearing 82 to rotate freely in eccentric aperture 80 and thereby reciprocate arm 70. Drive shaft 84 is connected to a complying 88 which is in turn connected to an output shaft 90 of a conventional electric drive motor 92. Drive shaft 84 has a pair of bushings 94 and 96 mounted thereon which busings are rotatably mounted in bearings 98 and 100, respectively. Bearings 98 and 100 are mounted in bearing supports 102 and 104, respectively, which supports are mounted in housing 12.

Figure 4:
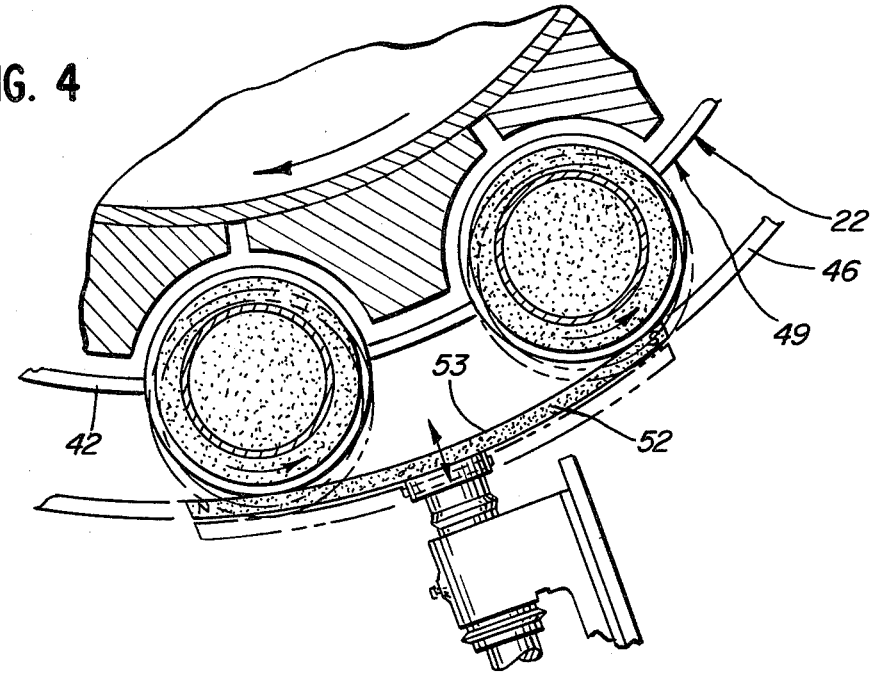
FIG. 4 is a partial enlarged cross sectional view showing two containers being attracted to the arcuate magnet and being rotatably held thereby during the filling operation.
Figure 5:
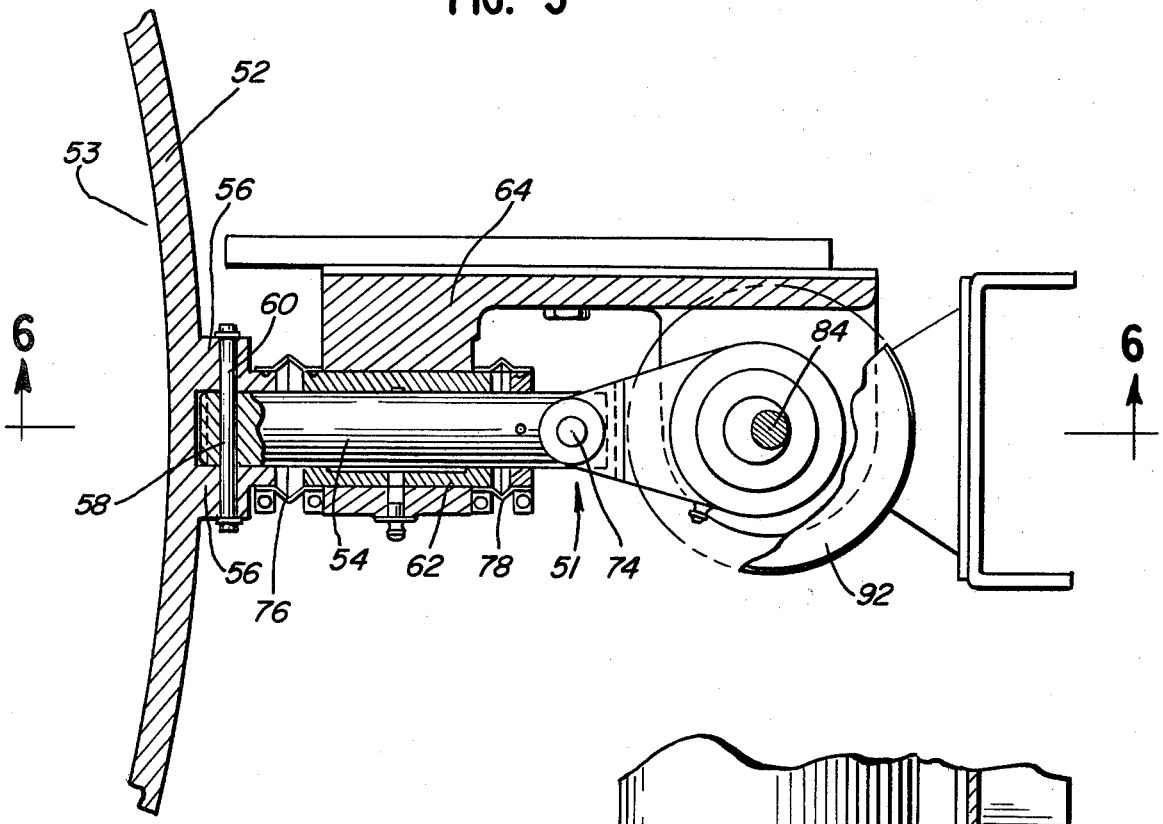
FIG. 5 is an enlarged partial cross sectional view showing the connection of the arcuate magnet to a magnet drive.
Figure 6:
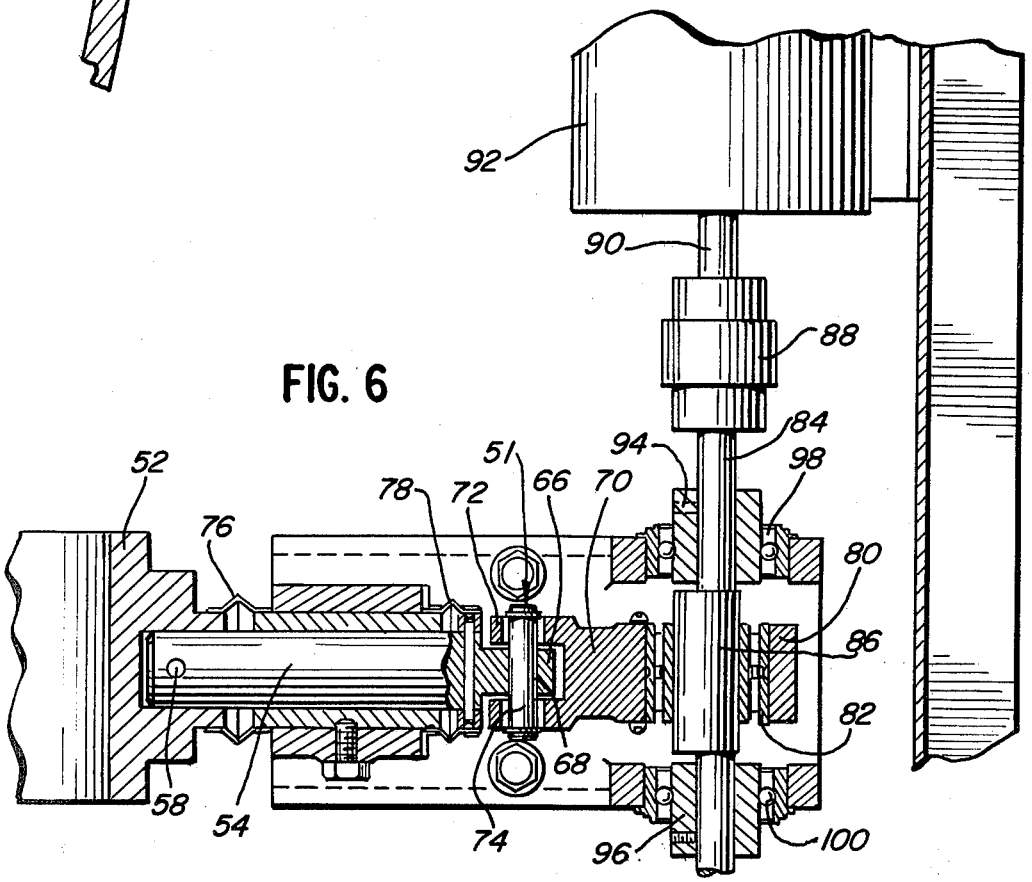
FIG. 6 is an enlarged partial cross sectional view taken on line 6—6 of FIG. 5.

In the operation of the present filling apparatus, empty containers 18 are delivered to the filling apparatus on input conveyer 12. Each of the containers is delivered to a container pocket 36 and container elevator 21 raises the containers so that each container telescopingly receives one of the measuring flasks 32. Divided material product which is contained in filling tank 28 then falls into the bottom of the measuring flask which is closed off by the container. The floor of the tank rotates until the measuring flask leaves the portion of the tank wherein the side wall retains the divided material to hold a given quantity of divided material product in each flask. The arcuate container support slopes downward so that the container drops down and the material product retained in the measuring flask flows into the container. The container and the measuring flask are then moved onto horizontal section 49 of the arcuate support wherein the bottom of the measuring flask is at the top of the container. Any material which is contained in the measuring flasks is retained in the measuring flask. The container is then carried proximate to magnet 52. Magnet 52 attracts the container to the magnet. As the pocket pushes the container along the magnet, the container rotates, that is, rolls along the magnet as is shown in FIG. 4.

The magnet is vibrated by the drive motor. The motor rotates eccentric 86 in the arm. The arm moves rod 54 along its longitudinal axis in sleeve 62. The vibration of the rod in the sleeve thus vibrates the magnet and any container which is magnetically attracting to the magnet. The vibration of the magnet causes the divided material to become packed in the respective container. It is important to note that the direction of the vibration of the container is continually changing as the container rolls along the magnet. Thus, the container has an axis of vibration which is continually radial to the container, but is constantly changing so that the container is vibrating from all sides. The continually changing in the direction of vibration results in a firm packing of divided material product in the container.

Any undesired voids in the material are eliminated thereby resulting in a solid pack of material.

Once the containers have been vibrated, the containers are carried down sloping section 50 of the arcuate support and are delivered to output conveyer 20. The filled containers are carried away.

Although a specific embodiment of the herein disclosed invention has been described in detail above and shown in the accompanying drawings, it is readily apparent that those skilled in the art may make various changes and modifications without departing from the spirit and scope of the present invention. It is to be expressly understood that the instant invention is limited only by the appended claims.

What is claimed is:

1. In an apparatus for filling like magnetic containers with a like measured amount of divided material product including; a housing, a drive, a filling tank for holding product, said filling tank having a movable base connected to said drive, a plurality of product measuring devices connected to the movable base for receiving divided material product from the tank and measuring the amount of said product, said product measuring devices moving in a prescribed path, means connected to said drive for moving a container at the same rate as a product measuring device while the container is receiving a measured quantity of product from the product measuring device, the improvement comprising; a magnet positioned adjacent to a portion of the path of the product measuring devices for attracting containers with divided material product contained therein as they pass the magnet, and a vibrator connected to the magnet for vibrating the magnet and a container attracted to the magnet to compact the divided material product in the container.

2. In an apparatus for filling like magnetic containers with a like measured amount of divided material product as defined in claim 1; wherein the magnet has a surface adjacent to the path of the product measuring devices being parallel to the path of containers moving with the product measuring devices.

3. In an apparatus for filling like magnetic containers with a like measured amount of divided material product as defined in claim 1; wherein said vibrator includes means limiting the movement of the magnet to a direction substantially perpendicular to an adjacent portion of the path of movement of containers with the product measuring devices.

4. In an apparatus for filling like magnetic containers with a like measured amount of divided material product as defined in claim 1; wherein the vibrator includes vibrator drive means, an eccentric connected to the vibrator drive means, a crank connected to the eccentric, a rod having one end connected to the magnet and the other end connected to the crank, and a sleeve slidably receiving the rod and being fixed to said housing allowing the rod to move along the longitudinal axis of the rod.

5. In an apparatus for filling like magnetic containers with a like measured amount of divided material product as defined in claim 1; wherein said vibrator includes means limiting movement of the magnet to a direction radial to the path of the plurality of product measuring devices.

6. In an apparatus for filling like magnetic containers with a like measured amount of divided material product as defined in claim 1; wherein the vibrator includes, vibrator drive means, an eccentric connected to the vibrator drive means, a crank connected to the eccentric, a rod having one end connected to the magnet and the other end connected to the crank, and a sleeve reciprocally receiving the rod being fixed to said housing allowing the rod to move along the longitudinal axis of the rod; and said magnet having a surface adjacent to the path of the plurality of product measuring devices being parallel to the path of the containers moving with the plurality of product measuring devices.

7. In an apparatus for filling like magnetic containers with a like measured amount of divided material product as defined in claim 1; wherein the magnet has a surface adjacent to the path of the plurality of product measuring devices being parallel to a portion of the path of containers moving with the plurality of product measuring devices, and said vibrator having means limiting the direction of vibration of the magnet to a direction perpendicular to a portion of the surface adjacent to the path of the product measuring devices.

8. In an apparatus for filling like magnetic containers with a like measured amount of divided material product as defined in claim 1; wherein each of the product measuring devices is a measuring flask arranged in a substantially vertical attitude, said movable base moving in a circle, said measuring flasks moving in a circular path being concentric with the circle of the base, and an arcuate container support in said housing positioned below a portion of the path of the measuring flasks for holding containers in a telescoping relationship with selected measuring flasks and then allowing the containers to move downward relative to the selected measuring flasks through a given portion of the circular path of the measuring flasks.

9. In an apparatus for filling like magnetic containers with a like measured amount of divided material product as defined in claim 8; wherein the arcuate container support is level with the horizontal at a portion adjacent to the magnet.

10. In an apparatus for filling like magnetic continers with a like measured amount of divided material product as defined in claim 8; wherein the arcuate container support includes a portion having a drop, a flat portion adjacent to the drop, said flat portion being adjacent to the magnet, and a second drop portion adjacent to the flat portion, wherein the containers are lowered relative to the product measuring devices.

11. In an apparatus for filling like magnetic containers with a like measured amount of divided material product as defined in claim 8; wherein the arcuate container support is level at the portion adjacent to the magnet; and the vibrator includes, vibrator drive means, an eccentric connected to the vibrator drive means, a crank connected to the eccentric, a rod having one end connected to the magnet and the other end connected to the crank, and a sleeve reciprocally receiving the rod and being fixed to said housing allowing the rod to move along the longitudinal axis of the rod.

12. In an apparatus for filling like magnetic containers with a like measured amount of divided material product as defined in claim 8; wherein the arcuate container support includes a portion having a drop, a flat portion adjacent to the drop, said flat portion being adjacent to the magnet, and a second drop portion adjacent to the other end of the flat portion; and the vibrator includes, vibrator drive means, an eccentric connected to the vibrator drive means, a crank connected to the eccentric, an elongated rod having one end connected to the magnet and the other end connected to the crank, and a sleeve reciprocally receiving the rod and being fixed to said housing allowing the rod to move along the longitudinal axis of the rod.

13. In an apparatus for filling like magnetic containers with a like measured amount of divided material product as defined in claim 8; wherein the arcuate container support difines a portion of a circle having its center concentric with the circular path of the plurality of product measuring devices, said container support includes a drop portion, a flat portion having one end adjacent to the drop portion, said flat portion being adjacent to the magnet, and a second drop portion adjacent to the other end of the flat portion, and said vibrator including means limiting movement of the magnet in a direction radial to the circular path of the plurality of product measuring devices.

14. In an apparatus for filling like magnetic containers with a like measured amount of divided material product as defined in claim 8; wherein the arcuate container support is level at the portion adjacent to the magnet, said magnet having a surface adjacent to the measuring flasks being a part a circle concentric with the circle of rotation of the measuring flasks; and said vibrator includes; vibrator drive means, an eccentric connected to the vibrator drive means, a crank connected to the eccentric, a rod having one end connected to the magnet and the other end connected to the crank, and a sleeve reciprocally receiving the rod and being fixed to said housing allowing the rod to move along the longitudinal axis of the rod.

15. In an apparatus for filling like magnetic containers with a like measured amount of divided material product as defined in claim 8; wherein the arcuate container support includes a drop portion, a flat portion having one end adjacent to the drop portion, said flat portion being adjacent to the magnet, and a second drop portion adjacent to the other end of the flat portion; said magnet has a surface adjacent to the measuring flasks being a part a circle concentric with the circle of rotation of the measuring flasks; and said vibrator including means limiting the movement of the magnet in a direction radial to the circle of rotation of the measuring flasks.

16. In an apparatus for filling like magnetic containers with a like measured amount of divided material product as defined in claim 8; wherein the arcuate container support defines a portion of a circle concentric with the circular path of the plurality of measuring flasks, said container support includes a drop portion, a horizontally flat portion having one end formed integral with the drop, said flat portion being adjacent to the magnet, and a second drop portion adjacent to the other end of the flat portion; said magnet has a surface adjacent to the measuring flasks, said surface being a part of circle concentric with the circular path of the plurality of measuring flasks; and said vibrator includes; vibrator drive means, an eccentric connected to the vibrator drive means, a crank connected to the eccentric, a rod having one end connected to the magnet and the other end connected to the crank, and a sleeve connected to said housing reciprocally receiving the rod allowing the rod to move along the longitudinal axis of the rod and to limit the direction of movement of the magnet to a direction radial to the circular path of the plurality of measuring flasks.

* * * * *

UNITED STATES PATENT OFFICE

CERTIFICATE OF CORRECTION

PATENT NO. : 4,465,111

DATED : August 14, 1984

INVENTOR(S) : John C. Nalbach

It is certified that error appears in the above-identified patent and that said Letters Patent are hereby corrected as shown below:

Col. 1, Line 50, "circle", should be --circular--

Signed and Sealed this

*Twenty-sixth* Day of *February 1985*

[SEAL]

*Attest:*

DONALD J. QUIGG

*Attesting Officer* *Acting Commissioner of Patents and Trademarks*